US008986031B2

(12) United States Patent
Matoba et al.

(10) Patent No.: US 8,986,031 B2
(45) Date of Patent: Mar. 24, 2015

(54) CONNECTOR

(71) Applicant: Omron Corporation, Kyoto-shi, Kyoto (JP)

(72) Inventors: Masato Matoba, Kawasaki (JP); Seiji Shimada, Kusatsu (JP)

(73) Assignee: Omron Corporation, Kyoto (JP)

( * ) Notice: Subject to any disclaimer, the term of this patent is extended or adjusted under 35 U.S.C. 154(b) by 65 days.

(21) Appl. No.: 13/831,399

(22) Filed: Mar. 14, 2013

(65) Prior Publication Data

US 2013/0280947 A1 Oct. 24, 2013

(30) Foreign Application Priority Data

Mar. 15, 2012 (JP) ..... 2012-059302

(51) Int. Cl.

| | |
|---|---|
| ***H01R 11/22*** | (2006.01) |
| ***H01R 13/62*** | (2006.01) |
| ***H01R 12/77*** | (2011.01) |
| ***H01R 12/87*** | (2011.01) |
| *H01R 12/79* | (2011.01) |

(52) U.S. Cl.

CPC ..... *H01R 13/62* (2013.01); *H01R 12/774* (2013.01); *H01R 12/87* (2013.01); *H01R 12/79* (2013.01)

USPC ..... 439/267; 439/499

(58) Field of Classification Search

CPC ..... H01R 12/79; H01R 12/87; H01R 12/88; H01R 12/774; H01R 13/62

USPC ..... 439/77, 260, 266, 267, 325, 329, 492, 439/499

See application file for complete search history.

(56) References Cited

U.S. PATENT DOCUMENTS

| | | | | |
|---|---|---|---|---|
| 4,252,389 | A * | 2/1981 | Olsson | 439/65 |
| 4,252,392 | A * | 2/1981 | Whiteman, Jr. | 439/267 |
| 4,334,728 | A * | 6/1982 | Reynolds et al. | 439/267 |
| 8,323,044 | B2 * | 12/2012 | Tsunemura | 439/267 |

(Continued)

FOREIGN PATENT DOCUMENTS

| | | | |
|---|---|---|---|
| CN | 101057372 | A | 10/2007 |
| CN | 101252231 | A | 8/2008 |

(Continued)

OTHER PUBLICATIONS

State Intellectual Property Office of People's Republic of China First Office Action issued Dec. 10, 2014 (English Translation).

*Primary Examiner* — Khiem Nguyen

(74) *Attorney, Agent, or Firm* — Blakely Sokoloff Taylor & Zafman

(57) ABSTRACT

The present invention provides a connector in which insertion of a substrate up to a proper position enables achievement of an electrical connection between the substrate and a contact point member. The connector includes a housing with an insertion recessed portion into which a substrate is to be inserted, a contact point member that includes a contact point portion which is installed in the housing, protrudes into an insertion recessed portion, and is electrically connected to a conductive portion of the substrate to be inserted, and position determining member which moves the contact point member, when the substrate is inserted into the insertion recessed portion of the housing, in such a manner that the contact point member is retracted from the insertion recessed portion and then protrudes into the insertion recessed portion to make an electrical connection to a conductive portion of the substrate.

19 Claims, 14 Drawing Sheets

(56) References Cited

U.S. PATENT DOCUMENTS

| | | | | |
|---|---|---|---|---|
| 8,579,654 | B2 * | 11/2013 | Chen et al. | 439/495 |
| 2008/0254662 | A1 | 10/2008 | Koga | |

FOREIGN PATENT DOCUMENTS

| | | | |
|---|---|---|---|
| JP | 2001-155829 | A | 6/2001 |
| JP | 2009-129860 | A | 6/2009 |

* cited by examiner

CONNECTOR

BACKGROUND OF THE INVENTION

1. Technical Field

The present invention relates to a connector.

2. Related Art

Conventionally, there is a known connector which can prevent a lever from collapsing even if there is a slight external force or a vibration before or during insertion of a flexible printed circuit board (substrate) to save the time and effort of flexible printed circuit board insertion work (for example, refer to Japanese Unexamined Patent Publication No. 2009-129860).

However, with regard to the conventional connector, disclosed is only a configuration which can prevent the lever from collapsing due to a vibration, for example, before the insertion of the substrate or on other occasions. Therefore, the user has to determine whether the substrate is inserted up to a suitable position. Furthermore, the user needs to operate the lever, that is, to raise or push down the lever before and after making the determination.

SUMMARY

The present invention been devised to solve the problems described above, and an object thereof is to provide a connector in which only insertion of a substrate up to a proper position automatically completes an electrical connection between the substrate and a contact point member, and which allows the state of the connector to be recognized from the outside.

In accordance with one aspect of the present invention, there is provided a connector including a housing with an insertion recessed portion into which a substrate is to be inserted, a contact point member that is installed in the housing and that includes a contact point portion which protrudes into the insertion recessed portion and makes an electrical connection to a conductive portion of the substrate to be inserted, and a position determining member which moves the contact point member, when the substrate is inserted into the insertion recessed portion of the housing, in such a manner that the contact point portion is retracted from the insertion recessed portion, and then protrudes into the insertion recessed portion to make an electrical connection to the conductive portion of the substrate.

With this configuration, only the insertion of the substrate into the insertion recessed portion of the housing may automatically complete the electrical connection between the substrate and the contact point member.

The position determining member preferably moves depending on each movement in such a manner that the movement of the position determining member is recognizable from the outside of the housing.

This configuration enables checking for whether the electrical connection between the conductive portion of the substrate and the contact point portion of the contact point member is properly made to be performed from the outside of the housing, without needing additional work.

The position determining member may include a movement member that is movable between a first position where the contact point portion of the contact point member is retracted from the insertion recessed portion, and a second position where the contact point portion of the contact point member protrudes into the insertion recessed portion, and a latching member that position-determines the movement member in the second position, then moves to transport the movement member to position-determine the movement member in the first position when the substrate is inserted into the insertion recessed portion of the housing, and thereafter cancels the position-determined state when the substrate is inserted up to a proper position.

With this configuration, a state of an internal portion obtained by the insertion of the substrate into the housing may be recognized from a movement position of the movement member. In addition, since the position-determination of the movement member is achieved by the latching member, the state of the internal portion can be exactly recognized by establishing clear matching between the positions and the states of the internal portion.

The first position of the movement member may be distinguishable from the second position where the movement member protrudes from the housing.

With this configuration, the state, in which the contact point member is retracted from the insertion recessed portion by the substrate being inserted into the housing, can be easily recognized from the movement of the movement member, that is, from the outside of the housing.

The movement member preferably includes a shaft portion, and the contact point member preferably includes a holding portion that elastically holds the shaft portion of the movement member in a state of being installed in the housing.

With this configuration, not only an additional member for holding the movement member is made unnecessary but also a smooth movement of the movement member may be performed because of the elastic holding.

The holding portion of the contact point member preferably urges the movement member positioned in the first position in such a manner that the movement member is able to move to the second position.

With this configuration, only the canceling of the latched state by the latching member may automatically make a movement of the movement member that is positioned-determined in the first position to the second position, because of the elastic force exerted by the holding portion of the contact point member.

The movement member preferably includes an abutting receiving portion, and the movement member preferably moves from the second position to the first position when the substrate which is to be inserted into the housing is brought into contact with the abutting receiving portion and then inserted inward further.

With this configuration, the insertion of the substrate into the housing may enable the movement of the movement member from the second position to the first position via the abutting receiving portion.

The movement member may be supported by the holding portion of the contact point member in such a manner as to rotate about the shaft portion, and the movement of the movement member from the first position to the second position may be achieved by the rotation about the shaft portion in a direction in which the substrate is inserted.

With this configuration, the second position can be provided inside the housing, and the movement member may be configured in a manner not to protrude from the housing after the installation of the substrate. This makes the whole structure compact.

The substrate preferably includes a latching notch portion, the movement member preferably moves from the first position to the second position by the substrate being inserted up to an installation completion position, and the abutting receiving portion of the movement member may be latched onto the latching notch portion of the substrate.

With this configuration, since only the insertion of the substrate up to a proper position completes the latching of the abutting receiving portion of the movement member onto the latching notch portion of the substrate, slipping-off of the substrate may be prevented.

The latching member may include a pressure receiving portion that is pressed by a leading end edge of the substrate inserted into the insertion recessed portion of the housing, an elastic portion that elastically deforms by the pressure receiving portion being pressed, and an arm portion that has a latch protrusion portion and separates the latch protrusion portion from the movement member by the elastic member which elastically deforms, and the movement member may include a first latch recessed portion onto which the latch protrusion portion formed in the arm portion is able to be latched when the movement member is positioned in the first position, and a second latch recessed portion onto which the latch protrusion portion formed in the arm portion is able to be latched when the movement member is positioned in the second position.

According to the present invention, whether the movement member has moved is recognizable from the outside by only inserting the substrate into the insertion recessed portion of the housing. Accordingly, whether the electrical connection between the conductive portion of the substrate and the contact point portion of the contact point member, which is performed inside the housing, is properly performed can be checked, without needing excessive work.

BBRIEF DESCRIPTION OF THE DRAWING(S)

DETAILED DESCRIPTION

Hereinafter, embodiments of the present invention will be described with reference to the accompanying drawings. It is to be noted that the terms (for example, terms including "upward," "downward," "sideways," "end," "front," and "rear") expressing specific directions and positions be used if necessary in the following description, but these terms be used only for an easy understanding of the present invention described with reference to the drawings, and the meanings of these terms not limit a technical scope of the present invention. Furthermore, the following description is only an example in nature, and is not intended to limit the present invention, applications thereof, or uses thereof.

(First Embodiment)

Figure 1:
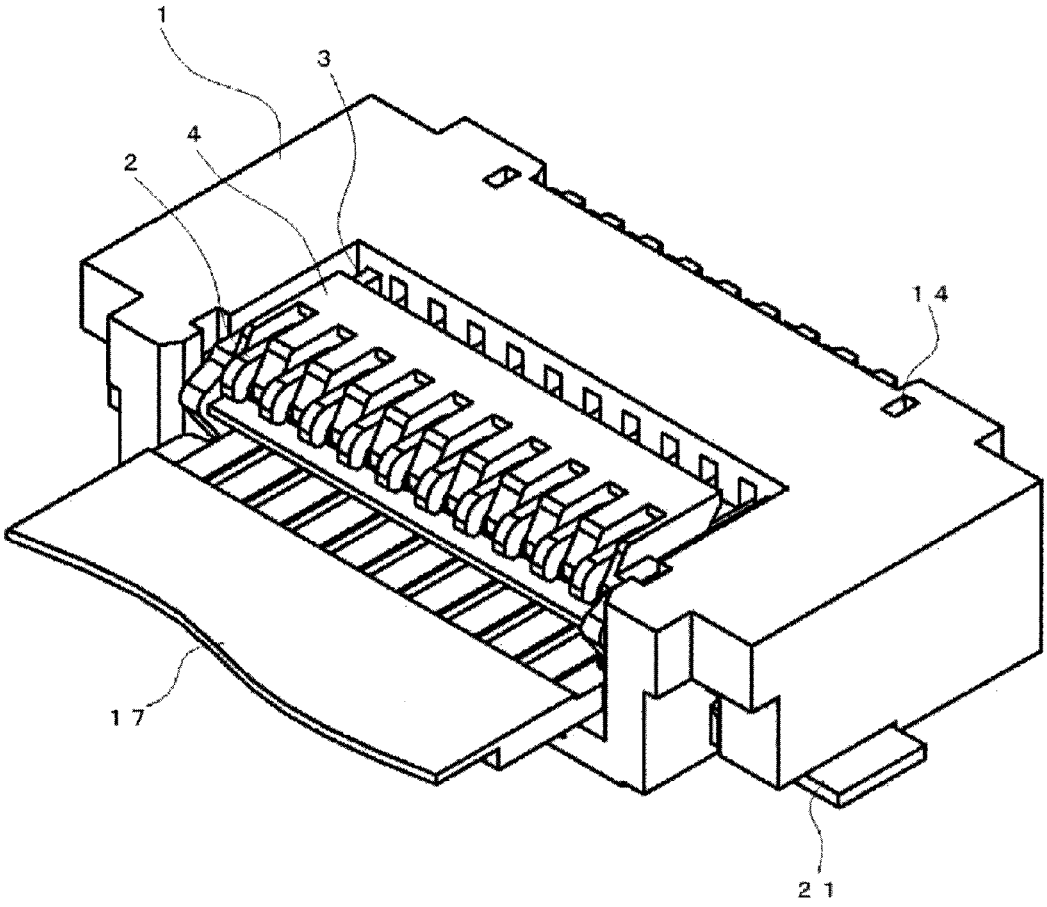
FIG. 1 is a perspective view illustrating a state in which a substrate is installed in a connector according to a first embodiment.
Figure 2:
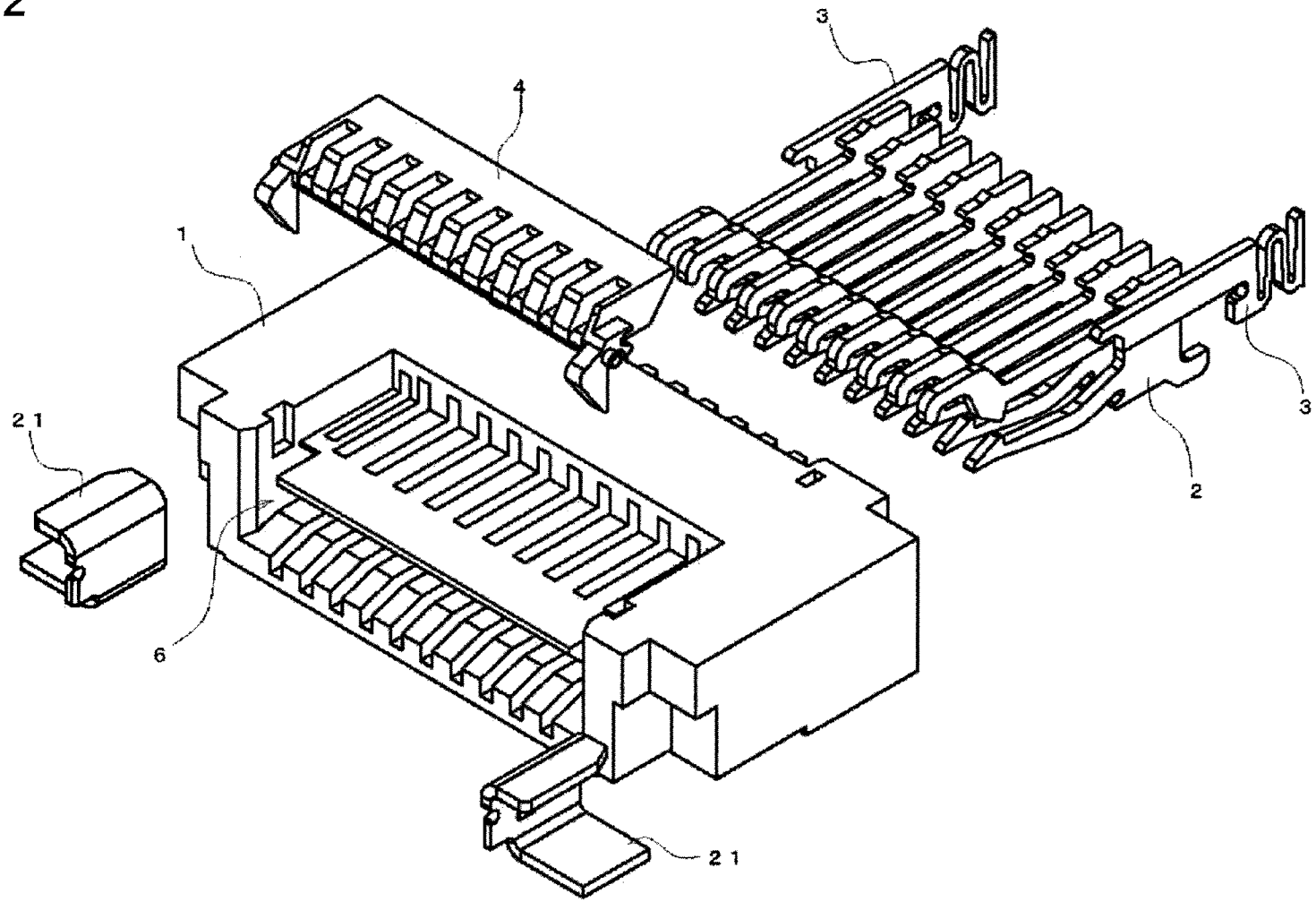
FIG. 2 is a perspective exploded view illustrating the connector in FIG. 1.

FIG. 1 is an overall view illustrating a connector according to a first embodiment, and FIG. 2 is a perspective exploded view illustrating the connector. The connector is configured by installing a contact point member 2, a latching member 3, and a movement member 4 to a housing 1.

Figure 3A:
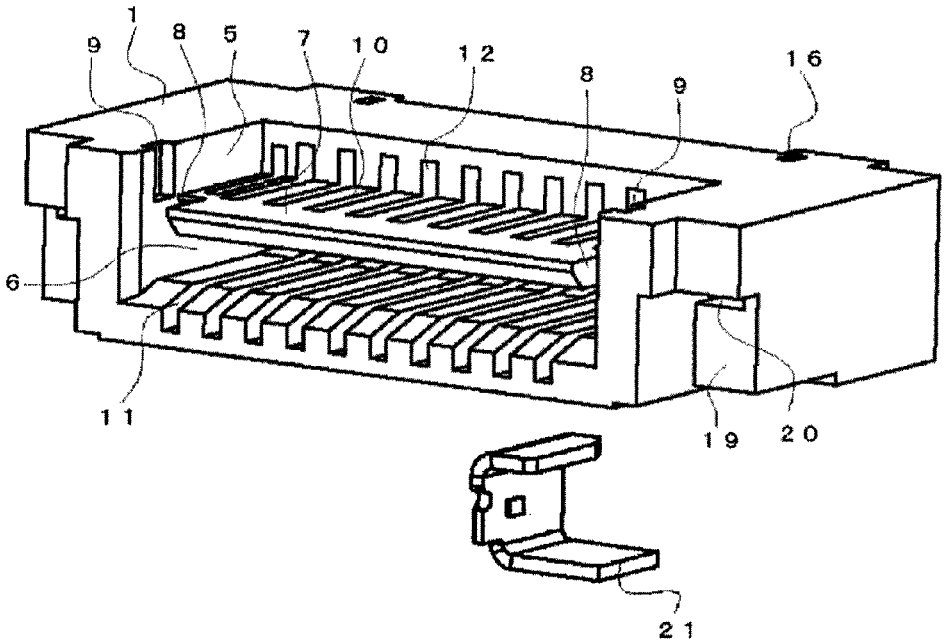
FIG. 3A is a perspective view illustrating a housing in FIG. 2 and one fixation fitting.
Figure 3B:
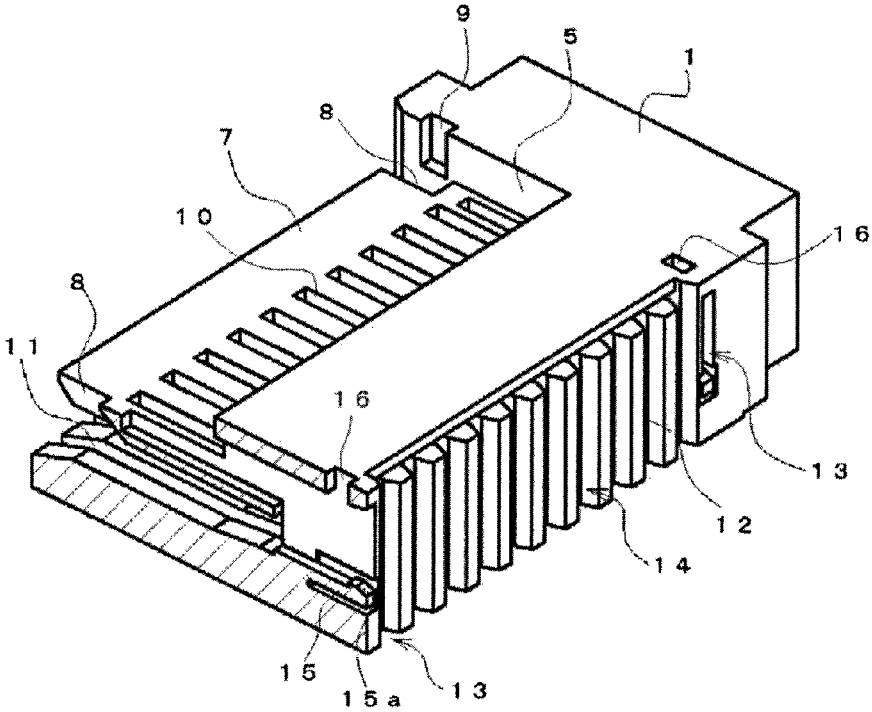
FIG. 3B is a perspective view of the housing in FIG. 2 which is partially cut away.
Figure 4:
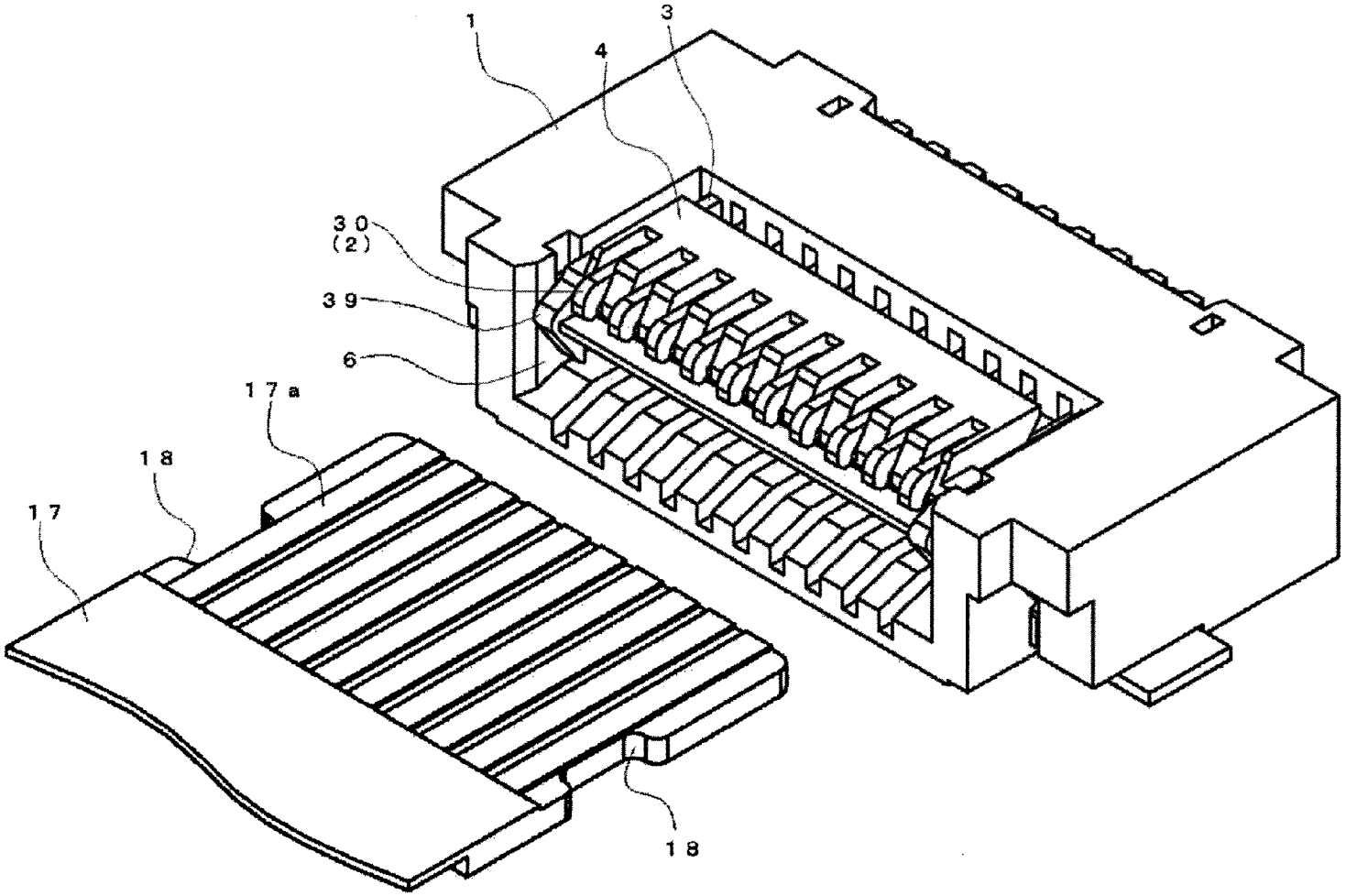
FIG. 4 is a perspective view illustrating a state of the substrate and the connector before the substrate is not installed in the connector according to the first embodiment.

As illustrated in FIGS. 3A and 3B, the housing 1 is a product manufactured by molding an electrically insulating resin material into an approximately rectangular paralleled piped shape. A recess 5 and an insertion recessed portion 6 are formed in the housing 1. The recess 5 is open in the direction of the upper surface and in the direction of the front surface. The insertion recessed portion 6 is provided under the recess 5 and is open in the direction of the front surface. The recess 5 and the insertion recessed portion 6 are separated by a partition wall 7. A front end portion of the partition wall 7 is positioned on the rear side compared to a position of the front surface of the housing 1, and notches 8 are formed at both sides of the partition wall, respectively. Guide recessed portions 9 are formed in both side surfaces of the recess 5 and the insertion recessed portion 6, and shaft portions 47 of movement members 4 described later are arranged in the guide recessed portions 9, respectively. In addition, a front portion of each of the both side surfaces of the recess 5 and the insertion recessed portion 6 is relatively broad in a width direction. This facilitates insertion of a substrate 17 (refer to FIG. 1).

A plurality of guide holes 10 are formed on the partition wall 7, at predetermined intervals in the width direction. The plurality of guide holes 10 are formed to communicate with the upper and lower surfaces and extend in the backward direction. Furthermore, guide groove portions 11 are formed in the bottom surface which makes up the insertion recessed portion 6. The guide groove portions 11 are formed to correspond to the guide holes 10, respectively and extend in the forward and backward directions. The guide holes 10 and the guide groove portions 11 communicate with insertion holes 12 in the rear surface side of the housing 1. The insertion holes 12 are open in the direction of the rear surfaces of the recess 5 and the insertion recessed portion 6 and in the direction of the rear surface of the housing 1. The guide holes 10, the guide groove portions 11, and the insertion holes 12, which are positioned at both side ends, make up a first attachment portion 13 for installing the latching member 3. The plurality of insertion holes 12, arranged in parallel between the insertion holes 12, make up a second attachment portion 14 for installing the contact point member 2. In each of the first attachment portions 13, a latching portion 15, which is elastically deformable downward and has a latching pawl 15*a* protruding upward from a leading end part, is formed in a rear end portion of the bottom surface making up the insertion hole 12. A latching hole 16 in the rectangular shape, which communicates with the insertion hole 12, is formed in a position corresponding to each of the latching portions 15, in an upper wall making up the insertion hole 12.

A lower surface of the front end of the partition wall 7 is an upward-inclined surface that is gradually inclined upward, along the direction of facing toward the front side. Furthermore, a front end part of the bottom surface of the insertion recessed portion 6 is a downward-inclined surface that is gradually inclined downward, along the direction of facing toward the front side. Furthermore, a front end part of an inside surface of each of both side walls is a sideways-inclined surface that is gradually inclined from side to side, along the direction of facing toward the front side. These inclined surfaces are for facilitating an insertion of the substrate 17 (refer to FIG. 1) into the insertion recessed portion 6. Here, an FPC (Flexible Printed Circuits: flexible printed circuit board) is used for the substrate 17. Latching notches 18 are formed in both side end portions of the substrate 17, respectively. Abutting receiving portions 39 of the movement member 4 described later are latched onto the latching notches 18, respectively when the substrate 17 is inserted into the insertion recessed portion 6 of the housing 1.

A release recessed portion 19 is formed in each of both end portions of the front surface of the housing 1, and an approximately L-shaped groove portion 20 being open in the direction of the front surface is formed in the release recessed portion 19. A fixation fitting 21 is fixed by being pressed into each groove portion 20 from the front side. The fixation fitting 21 is a metal plate member bent in the shape of a letter approximately like C. In the fixation fitting 21, the upper end wall and the side wall are pressed into the groove portion 20, the lower end wall is narrow in width, and the lower surface protrudes downward from the lower surface of the housing 1.

Figure 5:
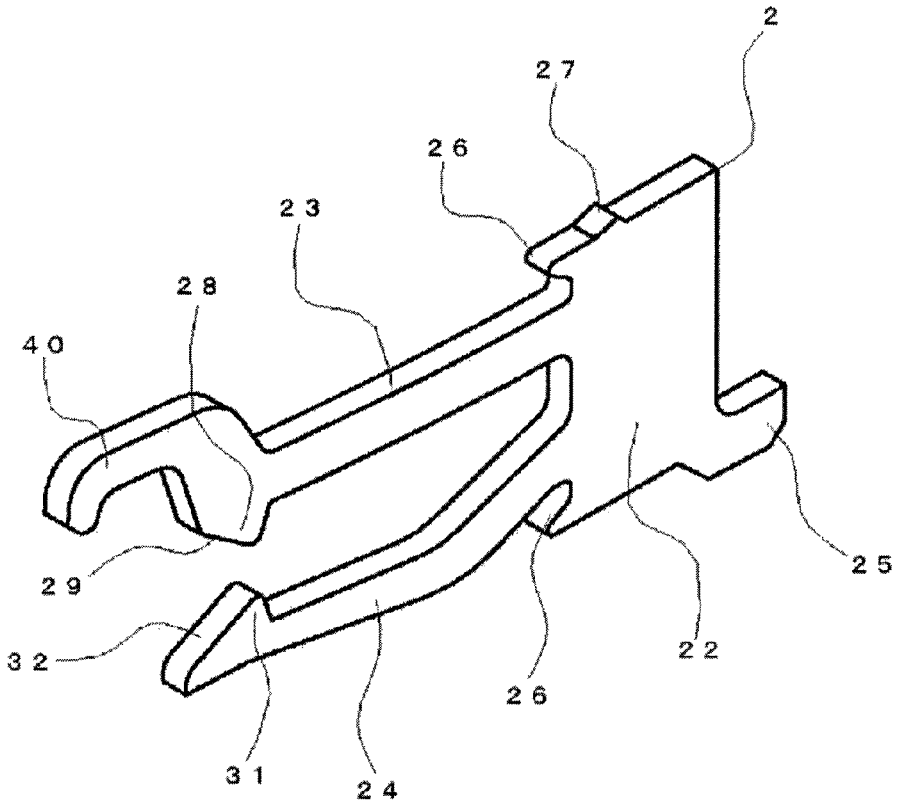
FIG. 5 is a perspective view illustrating a contact point member in FIG. 2.

As illustrated in FIG. 5, the contact point member 2 includes an installation portion 22 to be installed in the insertion hole 12, a first arm portion 23 and a second arm portion 24 which extend forward from an upper and a lower end portions of the front end edge of the installation portion 22, respectively, and a terminal portion 25 which extends from a lower portion of the rear end. The contact point member 2 is manufactured by performing press working on a conductive elastic plate. The contact point members 2 are installed in the second attachment portions 14, respectively that are installed in parallel in the housing 1.

Protrusion portions 26 are formed in an upper position in the first arm portion 23 and a lower position in the second arm portion 24, respectively in the front end edge of the installation portion 22. Furthermore, a press-in protrusion portion 27, which protrudes upward in the vicinity of the protrusion portion formed in the upper position, is formed in the upper end edge of the installation portion 22.

The first arm portion 23 protrudes forward from the installation portion 22, and a contact point portion 28 is formed in a manner to protrude downward from the leading end part of the first arm portion 23. The lower side of the leading end edge of the contact point portion 28 has an inclination portion 29 that gradually faces upward, along the direction of facing toward the leading end. A holding piece 30 is formed in the leading end part of the contact point portion 28. The holding piece 30 bulges upward substantially in the shape of a letter C. The holding piece 30 is in the form that conforms the upper half part of the shaft portion 43 of the movement member 4 described below. The holding piece 30 holds the shaft portion 43 to support the movement member 4 in a rotatable manner.

The second arm portion 24 obliquely extends downward from the installation portion 22, and thereafter protrudes in parallel with the first arm portion 23. A pressing portion 31, which protrudes upward from the leading end part of the second arm portion 24, is formed in a position facing the contact point portion 28 of the first arm portion 23. An inclination portion 32, which faces the inclination portion 29 of the first arm portion 23, is formed on the upper side of the leading end edge of the pressing portion 31.

Figure 6:
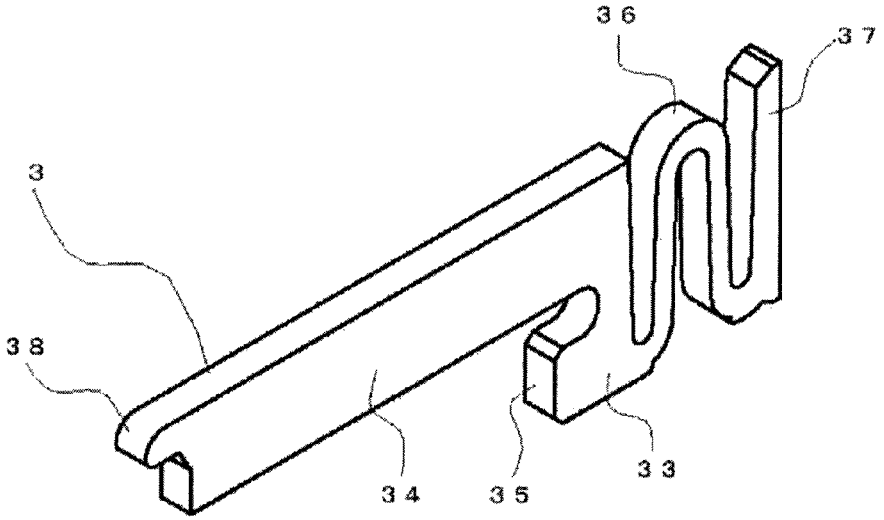
FIG. 6 is a perspective view illustrating a latching member in FIG. 2.

As illustrated in FIG. 6, the latching member 3 includes an installation portion 33, installed in the insertion hole 12, and an arm portion 34, which extends forward from an upper portion of the front end edge of the installation portion 33. The latching member 3 is obtained by performing a molding process using synthetic resin material. The two latching members 3 are installed in the first attachment portions 13 installed in parallel at both sides of the second attachment portion 14, respectively. A pressure receiving portion 35, which protrudes forward, is formed on a lower portion of the front end edge of the installation portion 22. The pressing pressure receiving portion 35 is pressed by the substrate 17 inserted into the insertion recessed portion 6 of the housing 1. An elastic portion 36 in the shape of a letter approximately U and a stopping portion 37, in succession to the elastic portion 36, are formed to extend from the rear end edge of the installation portion 22. The elastic portion 36 elastically deforms as the front end edge of the installation portion 22 is pushed by the substrate 17 inserted into the insertion recessed portion 6 as described below. The stopping portion 37 elastically deforms the latching portion 15 formed in the first attachment portion 13 of the housing 1, so that a rear end upper portion is latched onto a latching hole 16 of the housing 1 and the latching pawl 15*a* which is on top is latched onto a rear end lower portion. A latch protrusion portion 38, which protrudes forward, is formed on an upper portion of the front end edge of the arm portion 34.

Figure 7A:
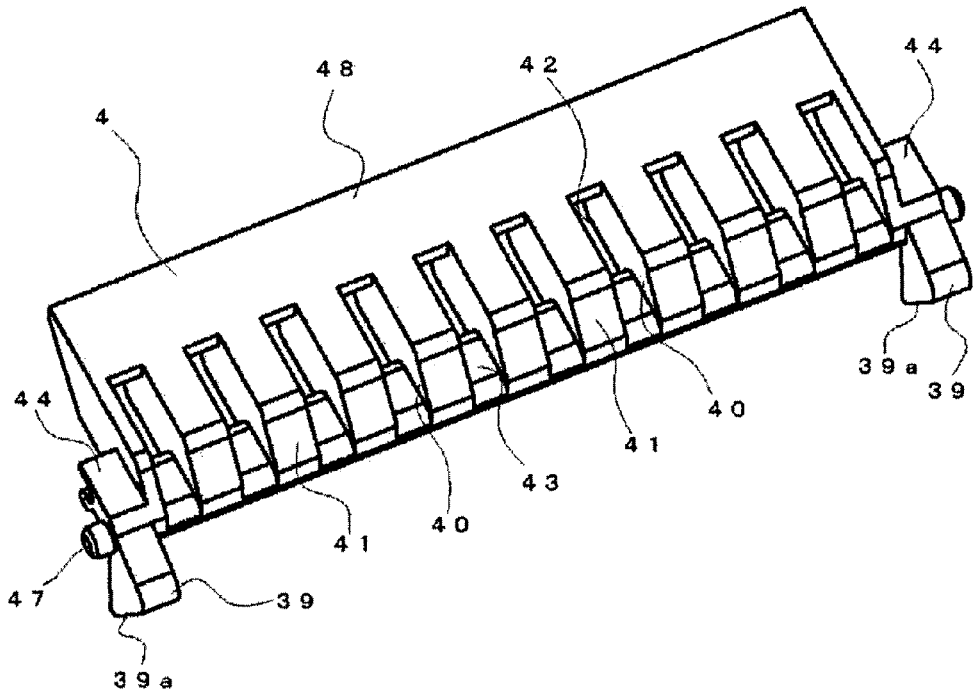
FIG. 7A is a perspective view illustrating a movement member in FIG. 2.
Figure 7B:
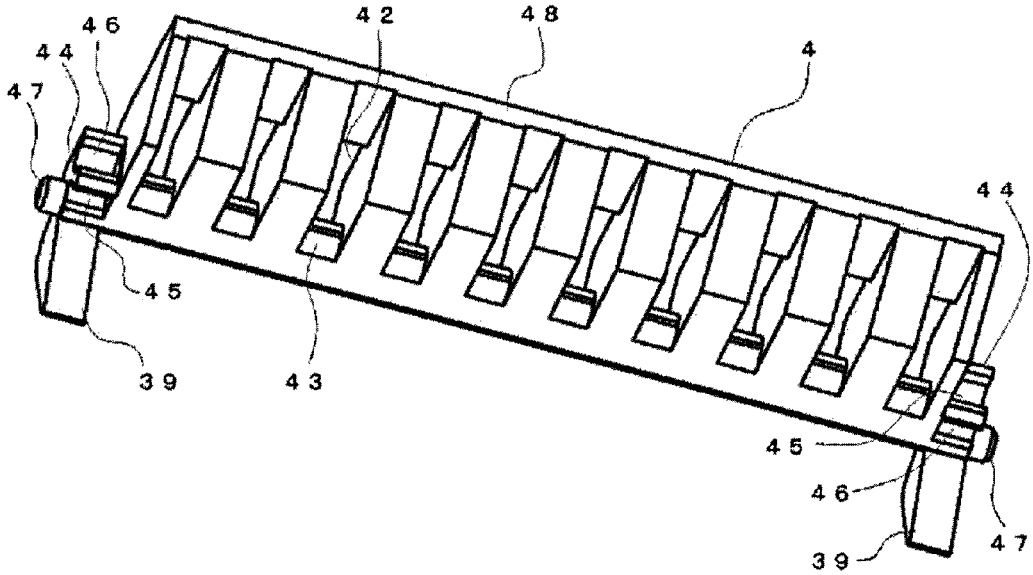
FIG. 7B is a perspective view illustrating a state of the movement member in FIG. 7A when viewed from a different angle.

As illustrated in FIGS. 7A and 7B, the movement member 4 is manufactured in the shape of a long plate by performing a molding process using synthetic resin material. The abutting receiving portions 39 protrude downward from both end portions of the movement member 4. A lower edge portion of each of the abutting receiving portions 39 is an inclination portion 39*a* which gradually protrudes downward, along the direction of facing toward the rear side. Thereby, if the substrate 17 is inserted into the insertion recessed portion 6, the leading end edge of the substrate 17 comes into contact with the inclination portion 39*a*, and the movement member 4 is made to be rotatable via the abutting receiving portion 39. Multiple guide walls 41 are formed in the upper surface half part of the movement member 4. The plurality of guide walls 41 are configured from a plurality of groove portions 40 that are provided at predetermined intervals in the width direction. Furthermore, a shaft portion 43 is formed every between the guide walls 41, by a communication hole 42 that is provided in the bottom surface of the first groove portion 40 in a manner to communicate upward and downward. The shaft portion 43 is configured from two plane surfaces, which are opposite to and in parallel with each other, and a pair of arc surfaces, which bulge outward. The shaft portion 43 is held by the holding piece 30 of the contact point member 2, and the movement member 4 is supported in a rotatable manner. Latch receiving portions 44, which protrude in the opposite direction of the abutting receiving portions 39, are formed at both end portions of the movement member 4, respectively. A first latch recessed portion 45 is formed in a lower portion of the latch receiving portion 44, and a second latch recessed portion 46 is formed in an upper portion of the latch receiving portion 44. A plane surface and an arc surface are in succession to each other in the first latch recessed portion 45 and the second latch recessed portion 46. The latch protrusion portions 38, which are formed in the arm portions 34 of the latching member 3, are latched onto or unlatched from the latch recessed portions 45 and 46. The lower surface of the movement member 4 comes into contact with the upper surface of the recess 5, and the upper surface of the movement member 4 is positioned in a horizontal position (a second position) where the upper surface of the movement member 4 is flush with the upper surface of the housing 1, in a state in which the latch protrusion portion 38 is latched onto the second latch recessed portion 46. On the other hand, the movement member 4 is positioned in a standing-up position (a first position) where the movement member 4 protrudes from the recess 5, in a state in which the latch protrusion portion 38 is latched onto the first latch recessed portion 45. The shaft portion 47, which is guided by the guide recessed portion 9 of the housing 1, protrudes from the end face of the latch receiving portion 44. When the movement member 4 is positioned in the standing-up position, the first arm portion 23 of the contact point member 2 is elastically deformed, urging the shaft portion 43 to move downward. For this reason, when the latch protrusion portion 38 is unlatched from the first latch recessed portion 45, the urging force makes the movement member 4 return back to the horizontal position. Moreover, the remaining half part (the side in which the guide wall 41 is not formed) of the movement member 4 serves as an operation portion 48 which is held by fingers for operation.

The connector having the above-mentioned configuration is assembled as follows.

First, the contact point members 2 are inserted into the insertion holes 12 in the second attachment portion 14 of the housing 1, respectively from the rear end side. The contact point member 2 is installed in the housing 1 when the installation portion 22 is inserted into the insertion hole 12 and the press-in protrusion portion 27 is brought into pressure contact with the inside surface of the insertion hole 12. In the installed state, the contact point portion 28 of the first arm portion 23 protrudes into the insertion recessed portion 6. In addition, the holding piece 30 protrudes into the recess 5, and a gap is formed between the leading end part of the holding piece 30 and the upper surface of the partition wall 7.

Subsequently, the movement member 4 is installed by using the holding piece 30 of the contact point member 2 which has protruded into the recess 5 of the housing 1. The shaft portion 43 of the movement member 4 is inserted into the gap that is formed between the leading end part of the holding piece 30 and the bottom surface of the recess 5, from the front side. The holding piece 30 deforms elastically first by the shaft portion 43 of the movement member 4, and then returns to its original form, to hold the shaft portion 43. As a result, the installation of the movement member 4 is completed. In this state, the movement member 4 is position-determined in the horizontal position.

After that, the latching member 3 is inserted into the insertion hole 12 formed in the second attachment portion 14, from the rear surface side. The installation of the latching member 3 may be completed by inserting the arm portion 34 into the insertion hole 12, and press-fitting the installation portion 33. In this state, the latch protrusion portion 38 of the latching member 3 is latched onto the second latch recessed portion 46 of the movement member 4 positioned in the horizontal position.

Figure 8A:
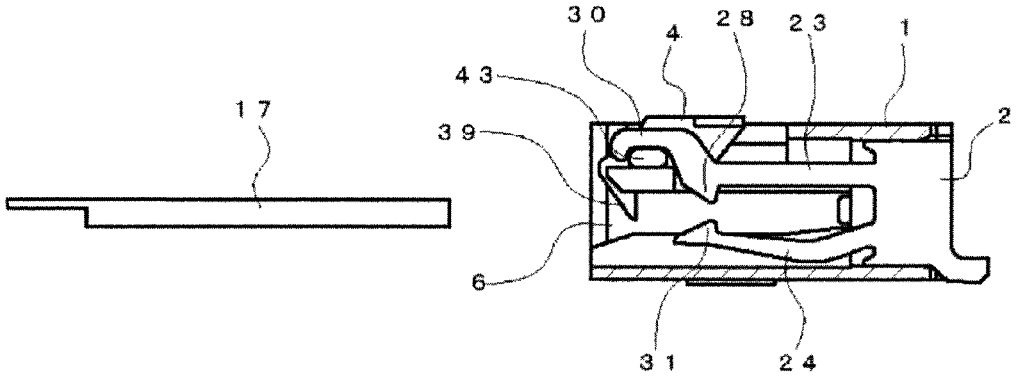
FIG. 8A is, a cross-sectional view illustrating the connector and the substrate in FIG. 4 at a position from which the contact point member can be viewed.
Figure 8B:
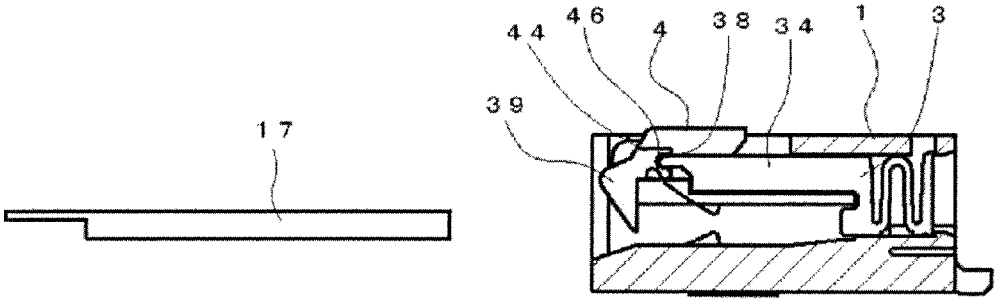
FIG. 8B is a cross-sectional view illustrating the connector and the substrate in FIG. 4 at a position from which the latching member can be viewed.
Figure 9A:
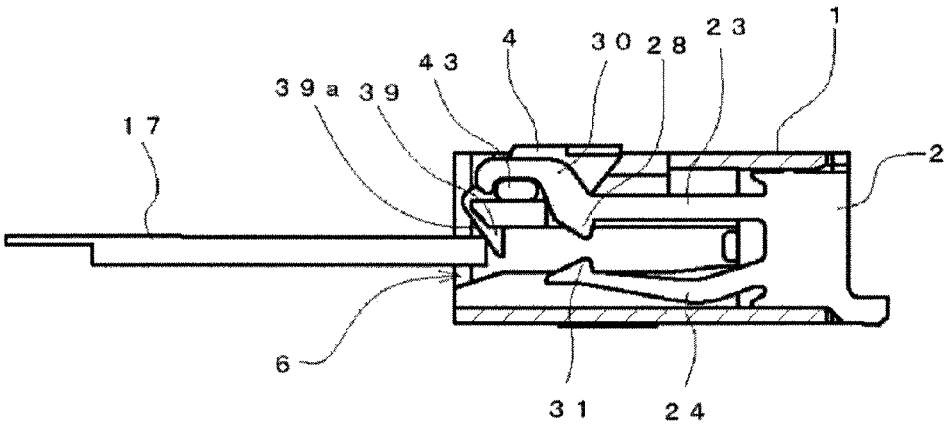
FIG. 9A is a view illustrating a state in which the substrate is inserted into an insertion recessed portion of the connector in FIG. 8A and a leading end edge thereof comes into contact with an abutting receiving portion of the movement member.
Figure 9B:
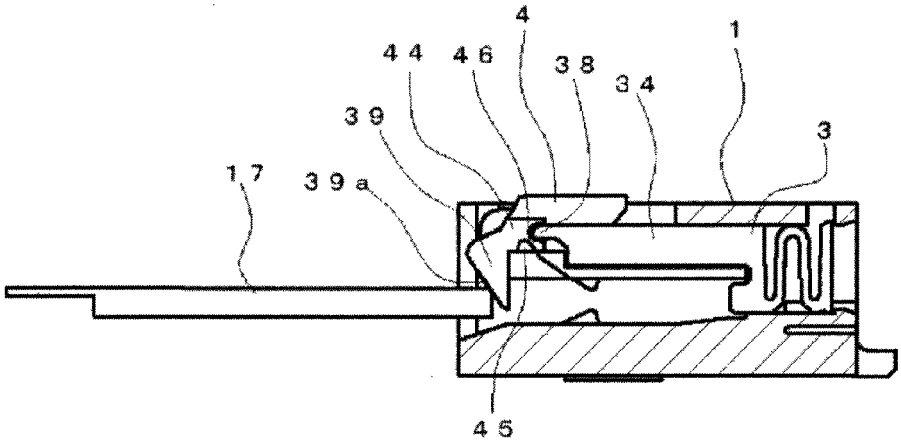
FIG. 9B is a view illustrating a state in which the substrate is inserted into the insertion recessed portion of the connector in FIG. 8B and the leading end edge thereof comes into contact with the abutting receiving portion of the movement member.

Thus, in the assembled connector, when installing the substrate 17, insertion of the substrate 17 into the insertion recessed portion 6 of the housing 1 as it is from the state illustrated in FIGS. 8A and 8B may complete the installation of the substrate 17. As a result, the leading end edge of the substrate 17 comes into contact with the abutting receiving portion 39 of the movement member 4 which protrudes into the insertion recessed portion 6 as illustrated in FIG. 9A. In this state, the contact point portion 28 of the contact point member 2 protrudes into the insertion recessed portion 6. As illustrated in FIG. 9B, the latch protrusion portion 38 formed at the leading end of the arm portion 34 of the latching member 3 is latched onto the second latch recessed portion 46 of the movement member 4 and the movement member 4 is position-determined in the horizontal position (second position).

Figure 10A:
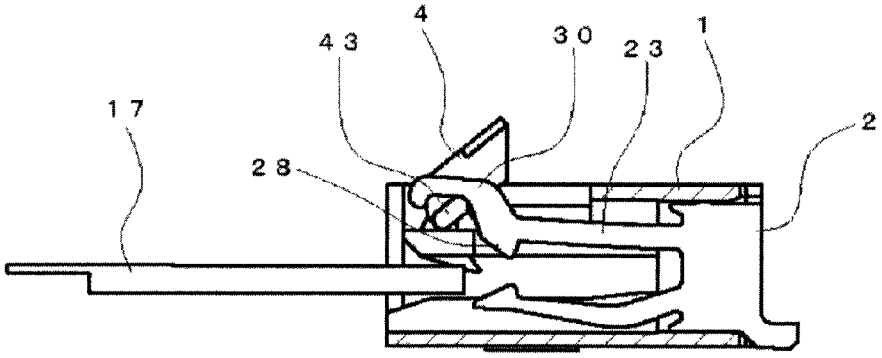
FIG. 10A is a view illustrating a state in which the substrate is further pushed in the insertion direction from the state in FIG. 9A.
Figure 10B:
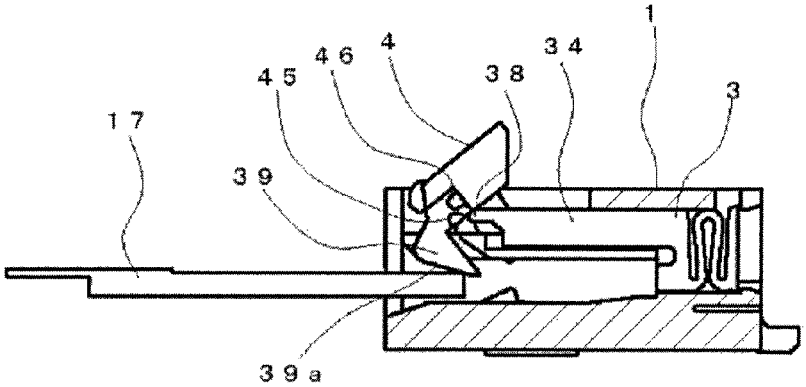
FIG. 10B is a view illustrating a state in which the substrate is further pushed in the insertion direction from the state in FIG. 9B.

And, if the substrate 17 is pushed into the insertion recessed portion 6, as illustrated in FIG. 10B, the abutting receiving portion 39 is pressed. Consequently, the movement member 4 counterclockwise rotates about the shaft portion 43 while resisting against the elastic force applied from the first arm portion 23 of the contact point member 2. Thereby, the latch protrusion portion 38 of the latching member 3 is unlatched from the second latch recessed portion 46 of the movement member 4. As illustrated in FIG. 10A, the first arm portion 23 of the contact point member 2 elastically deforms upward, and the contact point portion 28 is retracted from the insertion recessed portion 6.

Figure 11A:
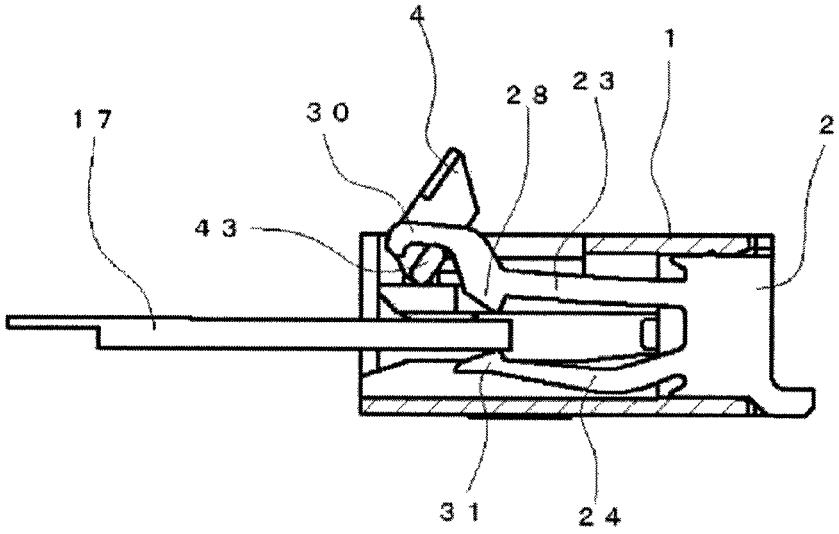
FIG. 11A is a view illustrating a state in which the substrate is further pushed in the insertion direction from the state in FIG. 10A and the substrate comes into contact with a contact point portion.
Figure 11B:
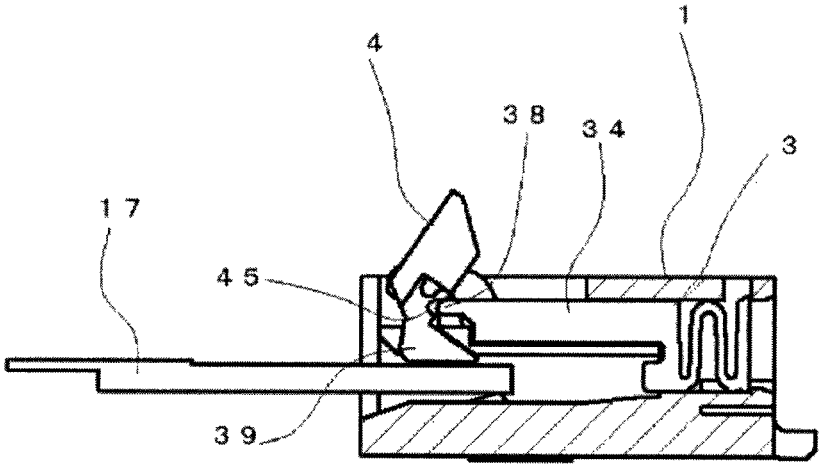
FIG. 11B is a view illustrating a state in which the substrate is further pushed in the insertion direction from the state in FIG. 10B and the substrate comes into contact with the contact point portion.

Then, as the substrate 17 is pushed into the insertion recessed portion 6 gradually, as illustrated in FIG. 11A, the movement member 4 rotates to be in the standing-up position (first position), and the contact point portion 28 is completely retracted from the insertion recessed portion 6. For this reason, a smooth insertion of the substrate 17 is performed without being hindered by the contact point portion 28. In addition, as illustrated in FIG. 11B, the latch protrusion portion 38 of the latching member 3 is latched onto the first latch recessed portion 45 of the movement member 4. As a result, the movement member 4 is position-determined in the above-mentioned standing-up position (first position).

Figure 12A:
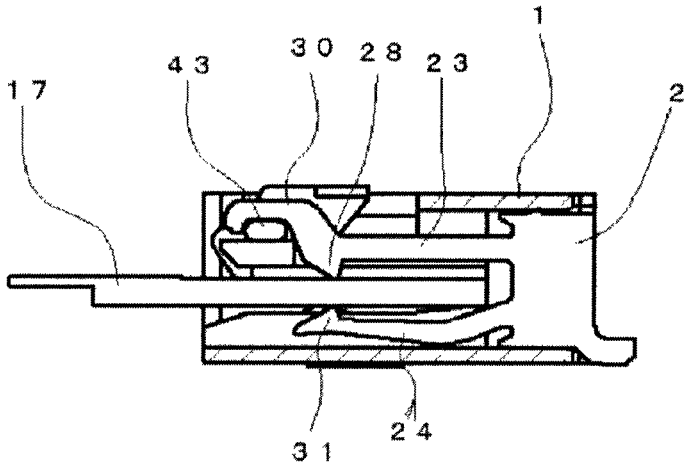
FIG. 12A is a view illustrating a state in which the substrate is further pushed in the insertion direction from the state in FIG. 11A and installation of the substrate is completed.
Figure 12B:
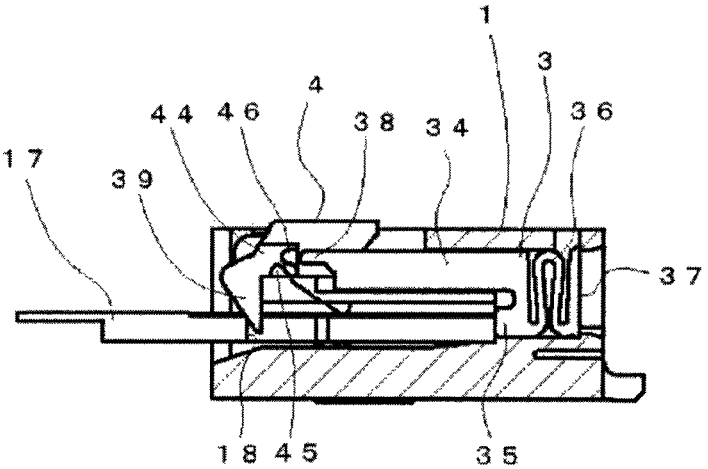
FIG. 12B is a view illustrating a state in which the substrate is further pushed in the insertion direction from the state in FIG. 11B and installation of the substrate is completed.

When the substrate 17 is further pushed into the insertion recessed portion 6, as illustrated in FIG. 12B, the leading end edge of the substrate 17 comes into contact with the pressure receiving portion 35 of the latching member 3. When the substrate 17 is pushed more inwards, the elastic portion 36 elastically deforms and the arm portion 34 moves backward. Thereby, the latch protrusion portion 38 provided at a leading end of the latching member 34 is unlatched from the first latch recessed portion 45 of the movement member 4. As a result, the movement member 4 enters a freely rotatable state, so that the movement member 4 rotates from in the standing-up position to in the horizontal position due to the elastic force of the first arm portion 23 of the contact point member 2. At this time, the abutting receiving portion 39 of the movement member 4 is latched onto the latching notch portion 18 of the substrate 17 so that slipping-off of the substrate 17 from the housing 1 may be prevented. As illustrated in FIG. 12A, the contact point portion 28 of the contact point member 2 comes into pressure contact with the conductive portion 17*a* of the substrate 17, and thus an electrical connection state is obtained.

As the insertion of the substrate 17 into the insertion recessed portion 6 in the housing 1 is in progress in this way, the movement member 4 rotates to be in the standing-up position, and after that returns to be in the horizontal position when the inserted substrate 17 reaches a proper position. Therefore, the user can check whether the installation of the substrate 17 is completed from the outside of the housing 1 by recognizing the rotation state of the movement member 4. Since the slipping-off of the substrate 17 from the housing 1 is prevented thanks to the abutting receiving portion 39 of the movement member 4, the stably installed state can be achieved.

(Second Embodiment)

Figure 13:
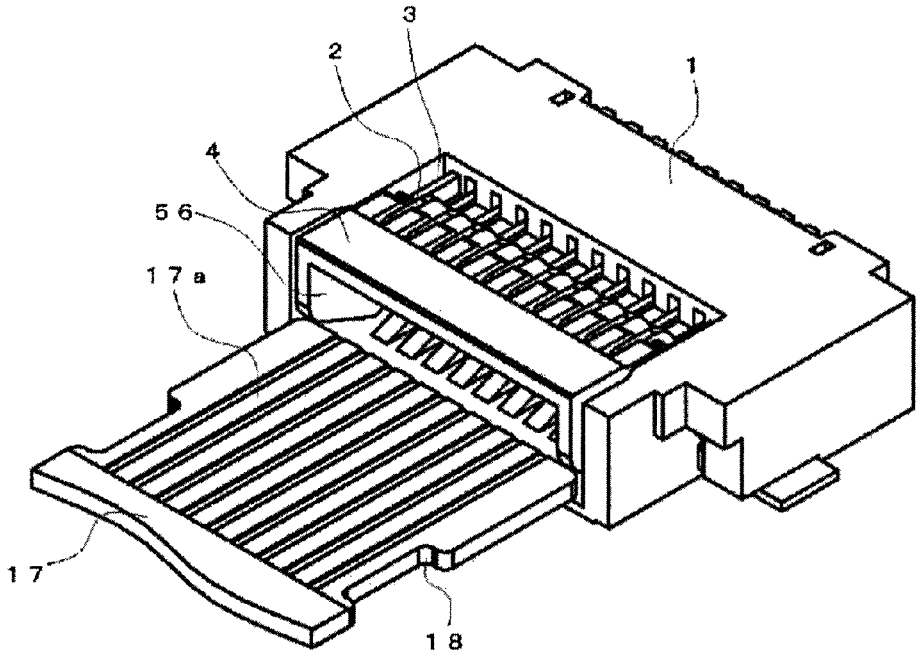
FIG. 13 is a perspective view illustrating a state of a substrate and a connector before the substrate is inserted into the connector according to a second embodiment.

FIG. 13 illustrates a connector according to a second embodiment. Because this connector is different from that of the first embodiment only in terms of one part of the construction of a movement member 4, but is almost the same in terms of the other configurations, a description of what has not any different construction is not repeated.

Figure 16A:
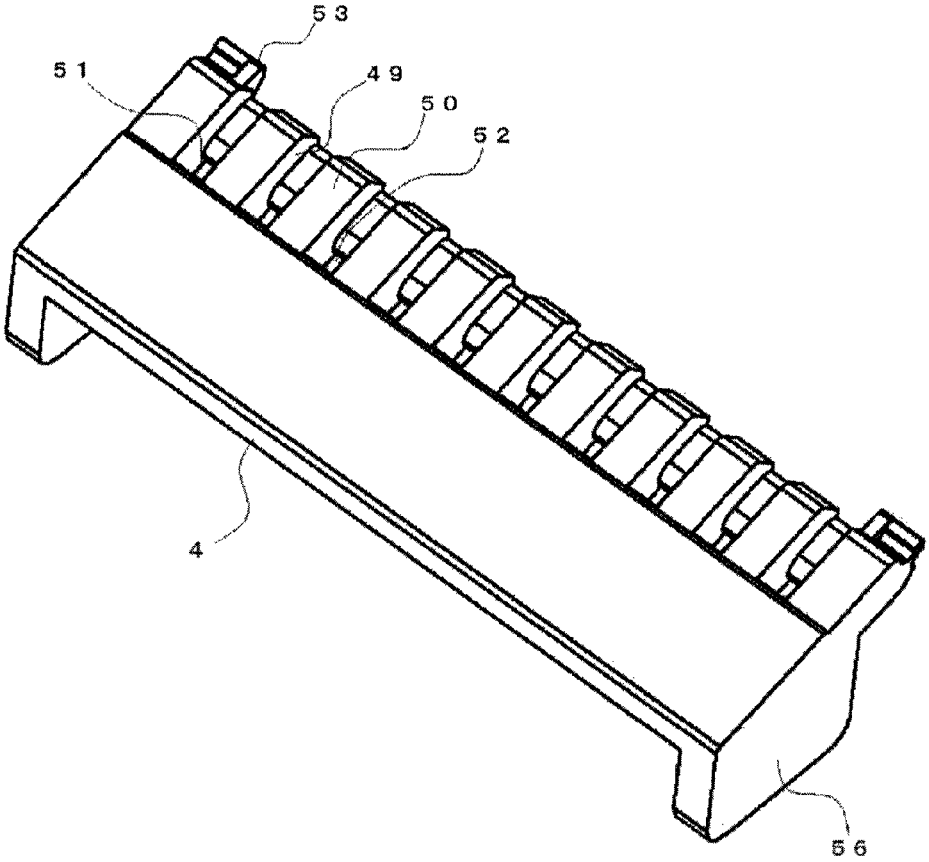
FIG. 16A is a perspective view illustrating a movement member in FIG. 13.
Figure 16B:
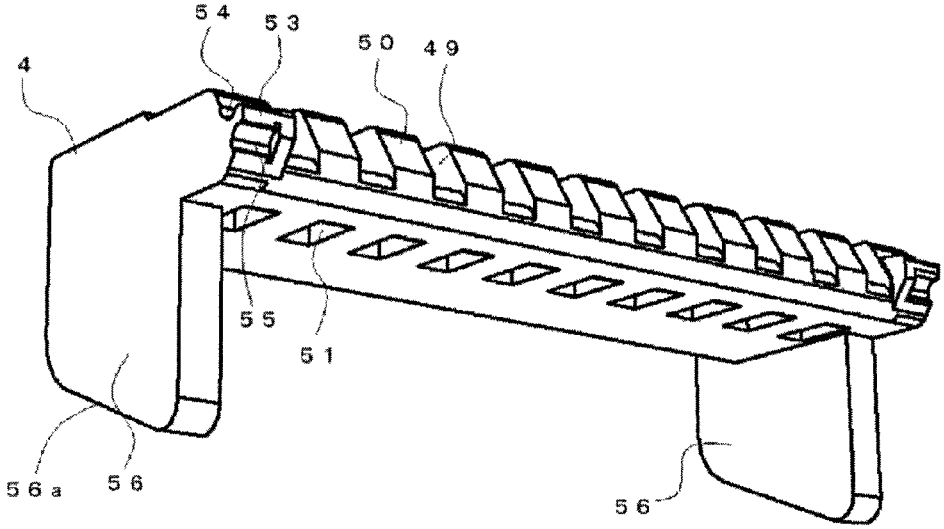
FIG. 16B is a perspective view illustrating a state of the movement member in FIG. 16A when viewed from a different angle.

As illustrated FIGS. 16A to 16B, a plurality of guide walls 50 are formed in a rear portion of the upper surface of the movement member 4. The plurality of guide walls 50 are configured from a plurality of groove portions 49 and arranged at predetermined intervals in the widthwise direction. A communicating hole 51 which communicates with the upper surface and the lower surface is provided in a front portion of the bottom surface of the groove portion 49. A shaft portion 52 is formed between the guide walls 50. Latch receiving portions 53 protrude forward from the guide walls 50 positioned at both end portions, respectively. A first latch recessed portion 54 and a second latch recessed portion 55 are formed in the latch receiving portions 53. Plate-like abutting receiving portions 56 protrude downward from both end portions, respectively. A lower end portion of each of the abutting receiving portions 56 includes an inclination portion 56*a* which gradually protrudes downward, along the direction of facing toward the rear side.

Figure 14:
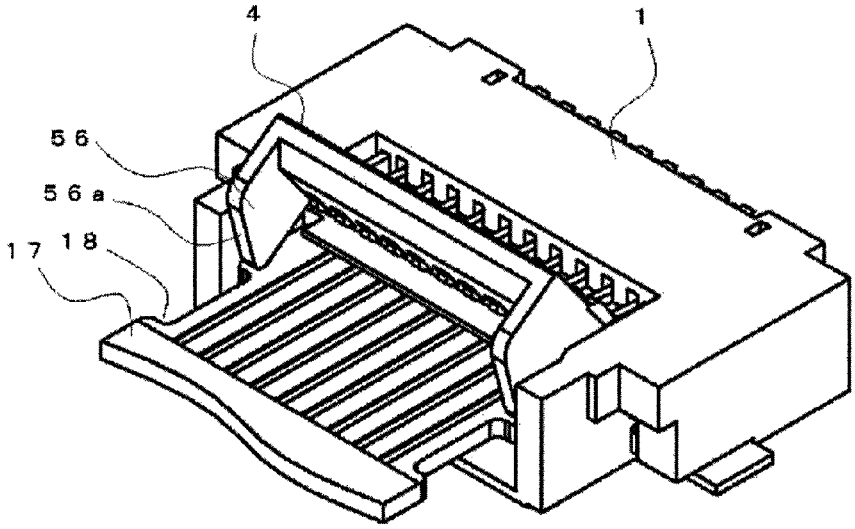
FIG. 14 is a view illustrating a state in which insertion of the substrate into the connector, which is in the state in FIG. 13, has been just started.
Figure 15:
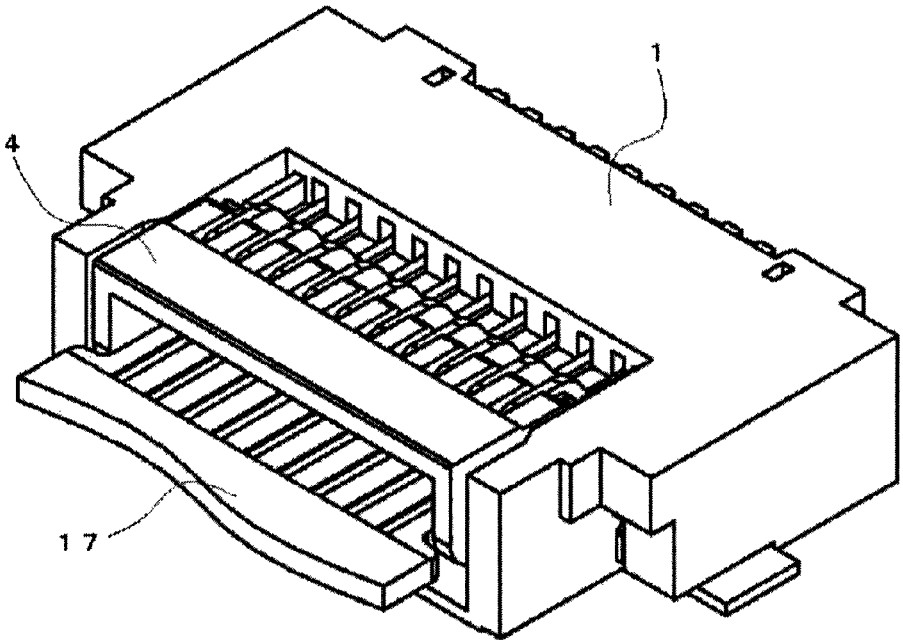
FIG. 15 is a view illustrating a state in which the substrate is further pushed in the insertion direction from the state in FIG. 14 and installation of the substrate is completed.

In the movement member 4 of this configuration, when a substrate 17 is inserted into an insertion recessed portion 6 of a housing 1 as illustrated in FIG. 13, the inclination portion 56*a* is pressed by a leading end edge of the substrate 17. This makes the movement member 4 rotate from a horizontal position to a standing-up position as illustrated in FIG. 14. At this time, like the first embodiment, a latching position of a latch protrusion portion 38 of a latching member 3 is switched from a second latch recessed portion 55 to a first latch recessed portion 54, and the movement member 4 is position-determined in the standing-up position.

If the substrate 17 is pushed inward further, the substrate 17 comes into contact with an abutting receiving portion 57 of the latching member 3 and an elastic portion 36 elastically deforms. As a result, the latch protrusion portion 38 is unlatched from the first latch recessed portion 54. Accordingly, the movement member 4 rotates from the standing-up position to the horizontal position by the elastic force of a first arm portion 23 of a contact point member 2 which is exerted on a shaft portion 52. Therefore, a contact point portion 28 which protrudes into the insertion recessed portion 6 comes into pressure contact with a conductive portion of the substrate 17, making an electrical connection. The user can recognize visually that the movement member 4 rotates from the horizontal position to the standing-up position, and then rotates again to the horizontal position. By recognizing this movement visually, it is possible to identify that the substrate 17 is inserted up to a proper position and an electrical connection between the contact point portion 28 of the contact point member 2 and the conductive portion of the substrate 17 is made, from the outside of the housing 1. At this time, the abutting receiving portion 56 of the movement member 4 is latched onto the latching notch portion 18 of the substrate 17 so that the substrate 17 may be prevented from being slip off the housing 1.

There has thus been shown and described a connector which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A connector comprising:

a housing that includes an insertion recessed portion configured to receive a substrate being inserted into the insertion recessed portion;

a contact point member that includes a contact point portion, the contact point portion being connected electrically to a conductive portion of the substrate when the substrate is fully inserted into the insertion recessed portion, the contact point member being installed in the housing, the contact point portion protruding into the insertion recessed portion; and a position determining member configured to move the contact point member, wherein as the substrate is being inserted into the insertion recessed portion of the housing, the contact point portion is moved by said position determining member so as to be retracted from the insertion recessed portion, and then is moved by said position determining member so as to protrude into the insertion recessed portion to make an electrical connection to the conductive portion of the substrate when the substrate is fully inserted into the insertion recessed portion, wherein a rotation state of the position determining member is observable from a location external to the housing.

2. The connector according to claim 1, wherein the position determining member includes:

a movement member that is movable between a first position where the contact point portion of the contact point member is retracted from the insertion recessed portion, and a second position where the contact point portion of the contact point member protrudes into the insertion recessed portion; and a latching member that position-determines the movement member to be in the second position, then moves the movement member to cause the movement member to be position-determined in the first position as the substrate is being inserted into the insertion recessed portion of the housing, and when the substrate is inserted up to a proper position, the latching member position-determines the movement member to be in the second position.

3. The connector according to claim 2, wherein the first position of the movement member is a position where the movement member protrudes from the housing and is distinguishable from the second position.

4. The connector according to claim 2, wherein the movement member includes a shaft portion, and wherein the contact point member includes a holding portion that elastically holds the shaft portion of the movement member in a state of being installed in the housing.

5. The connector according to claim 4, wherein the holding portion of the contact point member urges the movement member positioned in the first position in such a manner that the movement member is movable to the second position.

6. The connector according to claim 2, wherein the movement member includes an abutting receiving portion, and wherein the movement member moves from the second position to the first position when the substrate which is to be inserted into the housing is brought into contact with the abutting receiving portion and then inserted further.

7. The connector according to claim 4, wherein the movement member includes an abutting receiving portion, and wherein the movement member moves from the second position to the first position when the substrate which is to be inserted into the housing is brought into contact with the abutting receiving portion and then inserted further.

8. The connector according to claim 2, wherein the movement member is supported by a holding portion of the contact point member in such a manner as to rotate about the shaft portion, and the movement of the movement member from the first position to the second position is achieved by the rotation about the shaft portion in a direction in which the substrate is inserted.

9. The connector according to claim 4, wherein the movement member is supported by a holding portion of the contact point member in such a manner as to rotate about the shaft portion, and the movement of the movement member from the first position to the second position is achieved by the rotation about the shaft portion in a direction in which the substrate is inserted.

10. The connector according to claim 6, wherein the movement member is supported by a holding portion of the contact point member in such a manner as to rotate about the shaft portion, and the movement of the movement member from the first position to the second position is achieved by the rotation about the shaft portion in a direction in which the substrate is inserted.

11. The connector according to claim 7, wherein the movement member is supported by a holding portion of the contact point member in such a manner as to rotate about the shaft portion, and the movement of the movement member from the first position to the second position is achieved by the rotation about the shaft portion in a direction in which the substrate is inserted.

12. The connector according to claim 8, wherein the substrate includes a latching notch portion, the movement member moves from the first position to the second position by the substrate being inserted up to an installation completion position, and an abutting receiving portion of the movement member is latched onto the latching notch portion of the substrate.

13. The connector according to claim 9, wherein the substrate includes a latching notch portion, the movement member moves from the first position to the second position by the substrate being inserted up to an installation completion position, and an abutting receiving portion of the movement member is latched onto the latching notch portion of the substrate.

14. The connector according to claim 10, wherein the substrate includes a latching notch portion, the movement member moves from the first position to the second position by the substrate being inserted up to an installation completion position, and the abutting receiving portion of the movement member is latched onto the latching notch portion of the substrate.

15. The connector according to claim 11, wherein the substrate includes a latching notch portion, the movement member moves from the first position to the second position by the substrate being inserted up to an installation completion position, and the abutting receiving portion of the movement member is latched onto the latching notch portion of the substrate.

16. The connector according to claim 2, wherein the latching member includes a pressure receiving portion that is pressed by a leading end edge of the substrate inserted into the insertion recessed portion in the housing, an elastic portion that elastically deforms by the pressure receiving portion being pressed, and an arm portion that has a latch protrusion portion and that separates the latch protrusion portion from the movement member when the elastic member elastically deforms, and wherein the movement member includes a first latch recessed portion onto which the latch protrusion portion formed in the arm portion is able to be latched when the movement member is in the first position, and a second latch recessed portion onto which the latch protrusion portion formed in the arm portion is able to be latched when the movement member is positioned in the second position.

17. The connector according to claim 4, wherein the latching member includes a pressure receiving portion that is pressed by a leading end edge of the substrate inserted into the insertion recessed portion in the housing, an elastic portion that elastically deforms by the pressure receiving portion being pressed, and an arm portion that has a latch protrusion portion and that separates the latch protrusion portion from the movement member when the elastic member elastically deforms, and wherein the movement member includes a first latch recessed portion onto which the latch protrusion portion formed in the arm portion is able to be latched when the movement member is in the first position, and a second latch recessed portion onto which the latch protrusion portion formed in the arm portion is able to be latched when the movement member is positioned in the second position.

18. The connector according to claim 6, wherein the latching member includes a pressure receiving portion that is pressed by a leading end edge of the substrate inserted into the insertion recessed portion in the housing, an elastic portion that elastically deforms by the pressure receiving portion being pressed, and an arm portion that has a latch protrusion portion and that separates the latch protrusion portion from the movement member when the elastic member elastically deforms, and wherein the movement member includes a first latch recessed portion onto which the latch protrusion portion formed in the arm portion is able to be latched when the movement member is in the first position, and a second latch recessed portion onto which the latch protrusion portion formed in the arm portion is able to be latched when the movement member is positioned in the second position.

19. The connector according to claim 7, wherein the latching member includes a pressure receiving portion that is pressed by a leading end edge of the substrate inserted into the insertion recessed portion in the housing, an elastic portion that elastically deforms by the pressure receiving portion being pressed, and an arm portion that has a latch protrusion portion and that separates the latch protrusion portion from the movement member when the elastic member elastically deforms, and wherein the movement member includes a first latch recessed portion onto which the latch protrusion portion formed in the arm portion is able to be latched when the movement member is in the first position, and a second latch recessed portion onto which the latch protrusion portion formed in the arm portion is able to be latched when the movement member is positioned in the second position.

* * * * *